United States Patent [19]

Shibuya

[11] Patent Number: 4,464,101

[45] Date of Patent: Aug. 7, 1984

[54] SEIZURE-FREE, HIGHLY FLUID TIGHT AND LIGHTWEIGHT VANE COMPRESSOR

[75] Inventor: Tsunenori Shibuya, Konan-mura, Japan

[73] Assignee: T. Shibuya (Diesel Kiki Co., Ltd.), Tokyo, Japan

[21] Appl. No.: 355,926

[22] Filed: Mar. 8, 1982

[30] Foreign Application Priority Data

Mar. 14, 1981 [JP] Japan ..... 56-37047
Mar. 23, 1981 [JP] Japan ..... 56-41964

[51] Int. Cl.[3] ..... F04C 18/00; F04C 27/00; F04C 29/00

[52] U.S. Cl. ..... 418/125; 418/156; 418/178; 418/179

[58] Field of Search ..... 418/178, 179, 259, 125, 418/156

[56] References Cited

U.S. PATENT DOCUMENTS

| | | | |
|---|---|---|---|
| 3,044,687 | 7/1962 | Davey | 418/178 |
| 3,202,103 | 8/1965 | Sully | 418/178 X |
| 3,313,239 | 4/1967 | Brunson et al. | 418/179 |
| 3,552,895 | 1/1971 | Bayley | 418/179 |
| 3,620,654 | 11/1971 | Allen | 418/125 X |
| 3,788,783 | 1/1974 | Rosaen | 418/156 X |
| 3,920,360 | 11/1975 | Bieslein | 418/179 X |
| 3,934,321 | 1/1976 | Iida et al. | 418/178 X |
| 4,082,485 | 4/1978 | Sommer | 418/227 X |
| 4,094,618 | 6/1978 | Kakui et al. | 418/178 |
| 4,384,828 | 5/1983 | Rembold et al. | 418/178 X |

FOREIGN PATENT DOCUMENTS

| | | | |
|---|---|---|---|
| 2244444 | 3/1974 | Fed. Rep. of Germany | 418/156 |

*Primary Examiner*—Leonad E. Smith
*Assistant Examiner*—Ted Olds
*Attorney, Agent, or Firm*—Frishauf, Holtz, Goodman & Woodward

[57] ABSTRACT

In a vane compressor, a liner formed of iron or an alloy thereof is disposed along the endless camming inner peripheral surface of the cylinder forming part of the pump housing. The liner has at least one break extending thereacross and has its whole surface elastically permanently urging the cylinder in the radially outward directions. The use of the liner permits forming the rotor and the cylinder of aluminum or an alloy thereof. Preferably, the cylinder has its camming inner peripheral surface formed with a pair of elongate recesses extending parallel with the axis of the rotor and diametrically symmetrically arranged. The recesses are supplied with pumped compression fluid. The liner is partially urged by the rotor and located in the above recesses to maintain fluid tightness between the suction side and the discharge side in the pump housing.

6 Claims, 6 Drawing Figures

SEIZURE-FREE, HIGHLY FLUID TIGHT AND LIGHTWEIGHT VANE COMPRESSOR

BACKGROUND OF THE INVENTION

This invention relates to a vane compressor, and more particularly to a vane compressor which is light in weight and free from seizure of its component parts and also has improved fluid tightness between the suction side and the discharge side in the pump housing.

A vane compressor in general has a pump housing which is formed by a cylinder in which a rotor carrying vanes is fitted in concentricity therewith, and two side blocks secured to the opposite ends of the cylinder. The combined weight of the pump housing and the rotor occupies the greater part of the total weight of the compressor. Therefore, one would easily consider a vane compressor can be lighter in weight if it has its pump housing and rotor formed of aluminum or an alloy thereof (hereinafter called "aluminum metal"), like other types of compressors.

However, the vane compressors have the following peculiar problems, which currently necessitates manufacturing vane compressors which have only vanes formed of aluminum metal but have a pump housing and a rotor formed of iron or an alloy thereof (hereinafter called "ferrous metal"):

First, a vane compressor has many frictionally contacting portions, e.g. those between the rotor and the vanes, between the vanes and the cylinder and between the rotor and vanes and the side blocks. If two frictionally contacting parts are both formed of aluminum metal, seizure will easily take place between them, since aluminum metals are apt to adhere together when heated.

Secondly, in view of the vane compressor arrangement that compression chambers, which are defined by adjacent vanes, the rotor and the pump housing, are repeatedly expanded and contracted alternately to carry out fluid compressing action, the clearances between the rotor and the cylinder and between the rotor and the side blocks have to be kept at very small values with accuracy to obtain fluid-tightness between the suction side and the discharge side in the pump housing as well as minimize the friction resistance of the moving parts. However, if one of two contacting parts is formed of aluminum metal and the other ferrous metal, the clearance between these parts cannot be maintained at its proper value due to heat produced during operation of the compressor, because aluminum metals generally have much larger coefficients of thermal expansion than ferrous metals.

This problem is particularly serious at opposite sealing portions located between the inlet ports and the outlet ports of the cylinder, at which the rotor and the cylinder are disposed in contact with each other in a manner keeping fluid tightness between the suction side and the discharge side in the pump housing. The clearance between the rotor and the cylinder at these sealing portions should have a very small value of the order of 0.01-0.04 mm to minimize the leakage of fluid from the discharge side to the suction side on one hand, and to minimize the friction resistance between the rotor and the cylinder caused by rotation of the former on the other hand. To satisfy both of these two incompatible requirements, conventionally the clearance between the rotor and the cylinder at the sealing portions was set at the above small values. This required machining the rotor and the cylinder with very tight outer diameter and inner diameter tolerances, respectively. Further, abrasion of the rotor and the cylinder which proceeds with the operation of the compressor causes a gradual increase in the clearance between the two members at the sealing portions, resulting in a drop in the compression efficiency and a shortened life of the compressor.

OBJECTS AND SUMMARY OF THE INVENTION

It is an object of the invention to provide a vane compressor which has its main component parts formed of aluminum metal and includes a sheet member formed of ferrous metal, interposed between adjacent contacting aluminum metal-formed parts, thereby being light in weight as a whole and free from seizure of the adjacent aluminum metal-formed parts.

it is a further object of the invention to provide a vane compressor which is free from substantial changes in the clearances between component parts which are due to differences in coefficient of thermal expansion between the aluminum metal and the ferrous metal forming the component parts.

It is another object of the invention to provide a vane compressor which includes a liner as a sheet member, disposed over the inner peripheral surface of the cylinder wherein the above inner peripheral surface of the cylinder is formed with recesses, to obtain high fluid tightness between the rotor and the cylinder even with low machine tolerances due to cooperation of the recesses, the liner and the rotor, as well as to maintain uniform and stable contact between the liner and the rotor due to elasticity possessed by the liner, ensuring a lengthened life of the compressor.

According to the invention, a liner member which is formed of ferrous metal is disposed on the endless camming inner peripheral surface of a cylindrical peripheral wall member or cylinder forming part of the pump housing. The liner member has at least one break extending thereacross and has its whole surface elastically permanently urging the cylindrical peripheral wall member in the radially outward directions. Means are provided for preventing circumferential dislocation of the liner member. The use of the liner member permits forming the rotor and the cylindrical peripheral wall member of aluminum metal to thereby maintain the clearance between the two members at a proper value as well as to reduce the whole weight of the compressor.

Further, the cylindrical peripheral wall member has opposite inner peripheral surface portions defining the minimum inner diameter therebetween, each being formed with an elongate recess extending thereacross and parallel with the axis of the rotor and at least one bore for guiding pumped compression fluid into the interior of the elongate recess. The liner member is partially urgedly bent by the rotor and located in the recesses. The recesses, the liner member and the rotor cooperate to stably maintain high fluid tightness between the suction side and the discharge side in the pump housing, which are separated from each other by the rotor and the liner.

The above and other objects, features and advantages of the invention will be more apparent from the ensuing detailed description taken in connection with the accompanying drawings in which:

DETAILED DESCRIPTION

Figure 1:
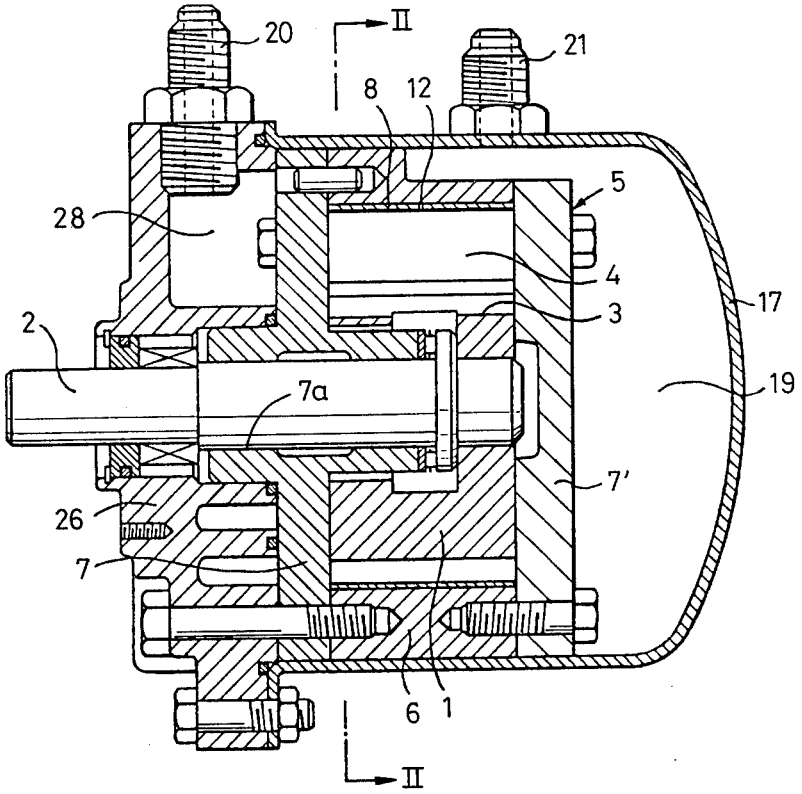
FIG. 1 is a longitudinal sectional veiw of a vane compressor according to a first embodiment of the invention.

The present invention will now be described in detail with reference to the drawings wherein like reference characters designate like or corresponding parts throughout the several views.

Figure 2:
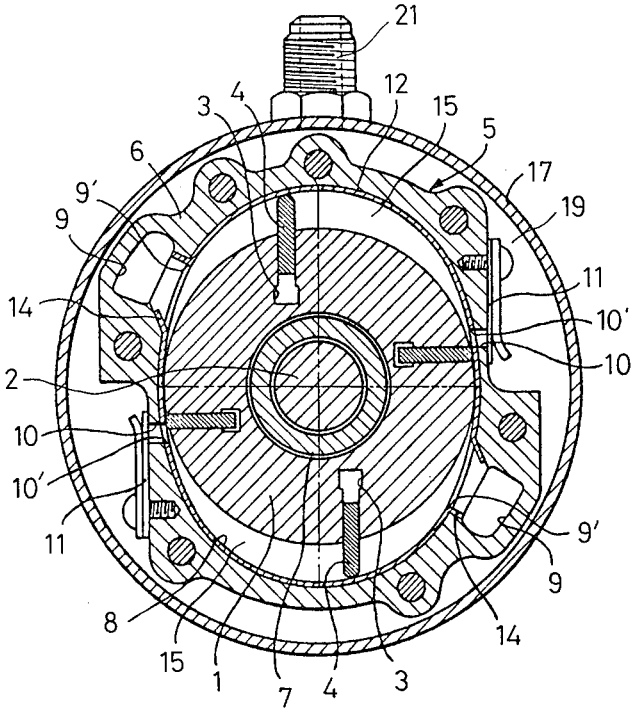
FIG. 2 is a sectional view taken along line II—II in FIG. 1.
Figure 3:
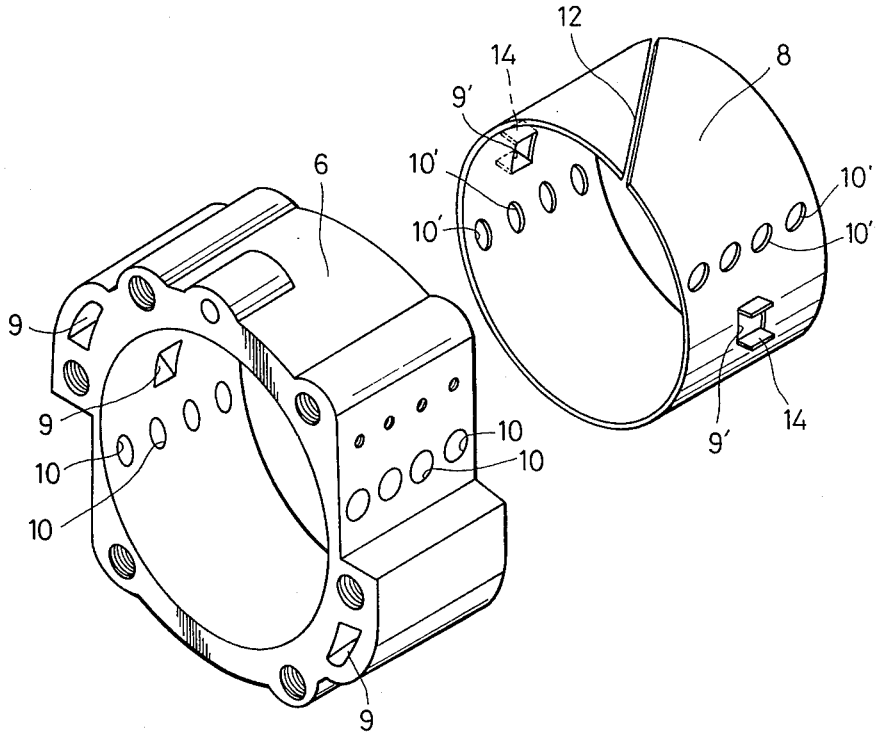
FIG. 3 is a perspective view of the cylinder and the liner appearing in FIGS. 1 and 2.

Referring first to FIGS. 1 through 3, one embodiment of the invention is illustrated. A cylindrical rotor 1 has a central axial bore 1*a* in which a drive shaft 2 formed of steel is rigidly fitted. The rotor 1 is formed of aluminum metal. It has its peripheral surface formed with four axial slits 3 which extend radially of the rotor with a phase difference of approximately 90 degrees. Four vanes 4, which are formed of ferrous metal, are fitted in these slits 3 for radial sliding motions therein. The rotor 1 and the vanes 4 are accommodated within a pump housing 5.

The pump housing 5 is formed by a cylinder 6 in which the rotor 1 is rotatably fitted in concentricity therewith, front and rear side blocks 7, 7′ secured to the opposite ends of the cylinder 6, and a liner 8 disposed on the inner peripheral surface of the cylinder 6.

The cylinder 6, which forms the peripheral wall of the pump housing 5, is formed of aluminum metal and has an endless camming inner peripheral surface having an oval cross section for instance. The cylinder 6 has a larger diameter portion defining the maximum inner diameter indicated by the one-dot chain line in FIG. 2 and a smaller diameter portion defining the minimum inner diameter indicated by the two-dot chain line in the same figure. It is formed with inlet ports 9 and outlet ports 10, the latter being closable by discharge valves 11. The side blocks 7, 7′, which form the opposite end walls of the pump housing 5, are formed of ferrous metal, with which the rotor 1 has its opposite end surfaces disposed in contact with a slight clearance therebetween. The front side block 7 rotatably supports the drive shaft 2 extending through its central axial bore 7*a*.

The liner 8 is applied over the whole endless camming inner peripheral surface of the cylinder 6. This liner 8 is formed of ferrous metal, for example, a flapper valve sheet which is a ribbon of hardened steel. The flapper valve sheet forming the liner 8 has a thickness of the order of 0.1–0.3 mm and is bent in an oval shape corresponding to the shape of the inner peripheral surface of the cylinder 6. In the present embodiment, the liner 8 has one break 12 extending thereacross and has its whole surface permanently urging the cylinder 6 in the radially outward directions due to its own elastic force. The break 12 has a width of 0.1–0.3 mm and extends obliquely with respect to the axis of the rotor 1 so that the vanes 4 can smoothly slide over the liner 23 without having their tips caught by the break 12. The main purpose of the break 12 is to allow the liner 12 to be expanded and contracted in the radial directions so that the liner 12 can unfold by itself due to its own elasticity as the rotor 1 and the cylinder 6 thermally expand during operation of the compressor, so as to prevent variations in the clearance between the rotor and the liner which would otherwise be caused by the thermal expansions of the rotor and the cylinder. The break 12 also facilitates inserting the liner 8 into the cylinder 6 since it allows the liner 8 to be forcedly contracted in the radial directions. The liner 8 is formed with inlet openings 9′ and outlet openings 10′ at locations corresponding, respectively, to the inlet ports 9 and outlet ports 10 of the cylinder 6. Sheet-like stoppers 14 are formed on the circumferentially opposite edges of each inlet opening 9′ and radially outwardly protrude therefrom. Rotation or circumferential dislocation of the liner 8 is prevented by engagement of the stoppers 14 in the inlet ports 10 of the cylinder 6. The means for prevention of rotation of the liner 8 is not limited to the illustrated one. Instead, engaging recesses may be formed in one or both of the side blocks 7, 7′ for engagement with stoppers formed on the liner 8.

The rotor 1 is disposed in substantial contact with the inner surface of the smaller diameter portion of the liner 8 with a very small clearance therebetween. The vanes 4 carried by the rotor 1 have their tips disposed for urging contact with the inner peripheral surface of the liner 8 for defining compression chambers 15 between adjacent vanes 4.

The pump housing 5 is enclosed by a front head 6 and an outer shell 17 in such a manner that a suction chamber 28 is defined by the pump housing 5 and the front head 26, and a delivery chamber 19 by the pump housing 5 and the outer shell 17, respectively. The suction chamber 28 communicates, on one hand, with a suction connector 20 having a suction valve, not shown, and secured to the front head 26, and also communicates, on the other hand, with the compression chambers 15 within the pump housing 5 via inlet ports 9 formed through the side block 7 on the front side and the cylinder 6 (the portions of the inlet ports 9 located in the side block 7 are not shown) and inlet openings 9′ formed through the liner 8. The delivery chamber 19 communicates, on one hand, with a discharge connector 21 secured to the outer shell 17, and, on the other hand, with the compression chambers 15 via outlet ports 10 and outlet openings 10′ formed, respectively, through the cylinder 6 and the liner 8. The outlet ports 10 are provided with discharge valves 11 at their outlet ends to be closed thereby.

With the above arrangement, as the rotor 1 rotates in unison with rotation of the drive shaft 2, the vanes 4 are circumferentially moved with their tips in sliding contact with the camming inner peripheral surface of the liner 8 to cause repeated alternate expansion and contraction of compression chambers 15 defined between adjacent vanes 4 for fluid compressing action. During this fluid compressing action, there occurs frictional contact between the rotor 1, the vanes 4, the liner 8 and the side blocks 7, 7′. However, since the vanes 4, the liner 8 and the side blocks 7, 7′ are formed of ferrous metal except for the rotor 1, the frictionally contacting parts are not apt to adhere to each other. Further, the frictionally contacting parts are supplied with lubricant oil by means of usual oil supply means. Thus, seizure of the frictionally contacting parts is prevented.

During the fluid compressing action, the rotor 1, which is formed of aluminum metal and therefore relatively large in coefficient of thermal expansion, largely thermally expands in the radially and axially outward directions due to heat generated by frictional contact of the frictionally contacting parts as well as increased temperature of the compression fluid caused by the fluid compressing action. On the other hand, the cylinder 6, which is also formed of aluminum metal, thermally expands in the radially and axially outward directions at a rate substantially equal to the rotor 1. Further, the liner 8 unfolds by itself due to its own elasticity with expansion of the cylinder 6. This unfolding of the liner 8 is possible by virtue of the presence of the break 12 in the line 8. Therefore, the clearance between the rotor 1 and the smaller diameter portion of the liner 8 is maintained at a proper value, since the width of the break 12 is very small as previously noted and hardly varies during operation of the compressor. Therefore, the amount of compression fluid leaked through the break is practically negligible, having no substantial influence upon the compressing action of the compressor.

Figure 4:
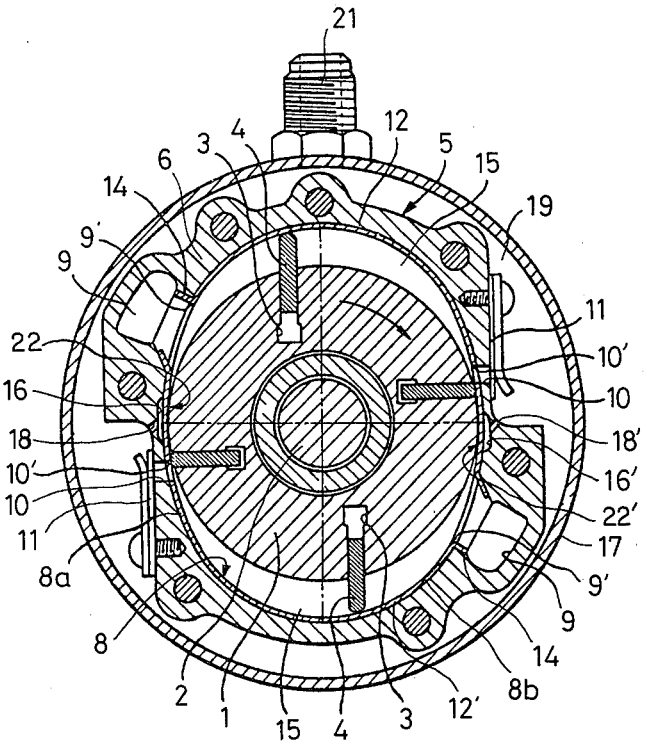
FIG. 4 is a transverse sectional view of a vane compressor according to a second embodiment of the invention.
Figure 5:
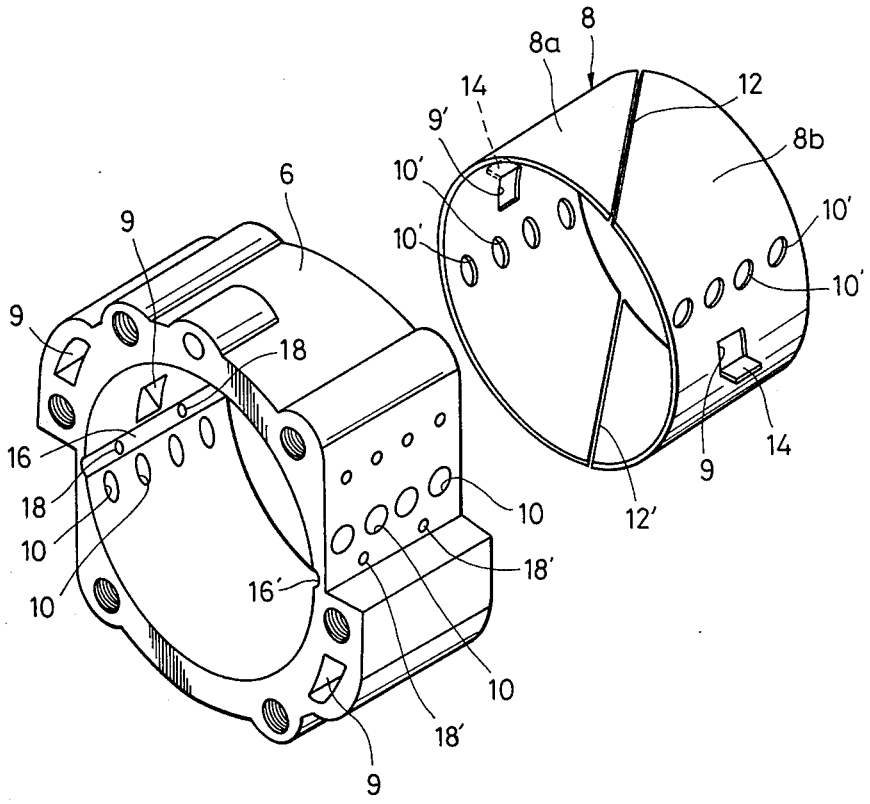
FIG. 5 is a perspective view of the cylinder and the liner appearing in FIG. 4.
Figure 6:
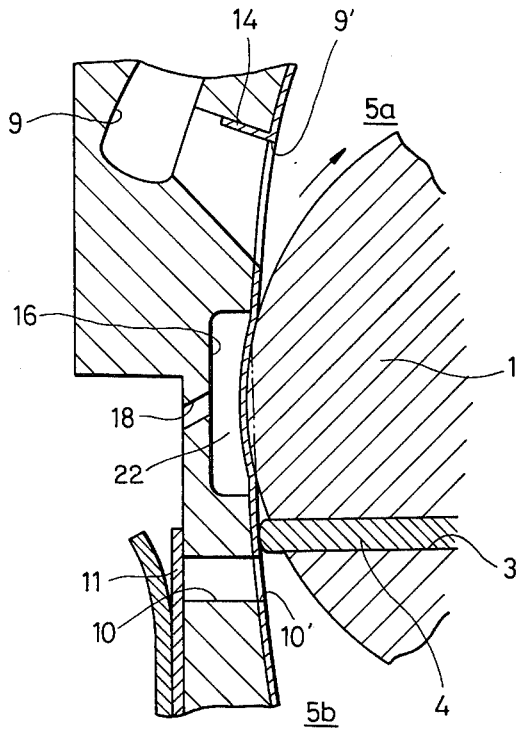
FIG. 6 is an enlarged sectional view of a sealing portion appearing in FIG. 4.

Referring next to FIGS. 4 through 6, there is illustrated another embodiment of the invention. According to this embodiment, the liner 8 has two breaks 12, 12', that is, it is composed of two liner elements 8*a*, 8*b*. On the other hand, the cylinder 6 has its endless camming inner peripheral surface formed with two elongate recesses 16, 16' in the form of channels extending thereacross and parallel with the axis of the rotor 1. These recesses 16, 16' are located between respective paired inlet ports 10 and outlet ports 11 formed in the cylinder 6, at the opposite inner peripheral surface portions defining the minimum inner diameter therebetween, in a diametrically symmetrical manner. The liner 8 has such a thickness of the order of 0.1–0.3 mm that when the rotor 1 is not fitted in the cylinder 6, the liner 8 applied along the inner peripheral surface of the cylinder 6 has an inner diameter smaller than the outer diameter of the rotor 1, at the locations of the recesses 16, 16'. Therefore, when the liner 8 is mounted into the cylinder 6, part of the liner 8 is urged by the rotor 1 to be bent into the recesses 16, 16' against its own elasticity. The bent portions of the liner 8, the recesses 16, 16' and the rotor 1 cooperatively form seals 22, 22' which provides sealing between the rotor 1 and the liner 8 to establish fluid tightness between the suction side 5*a* and the discharge side 5*b* in the pump housing 5. The recesses 16, 16' are formed with communication bores 18, 18' extending through its wall and opening in the bottoms of the respective recesses 16, 16' to communicate the interiors of the recesses 16, 16' with the delivery chamber 19 for supplying pumped compression fluid to the former.

The other portions of the vane compressor than the above mentioned ones are arranged in an identical manner with the arrangement according to the first embodiment shown in FIGS. 1 through 3, description of which is therefore omitted.

With the arrangement of FIGS. 4 through 6, as the rotor 1 rotates in the arrow direction in FIG. 4, the vanes 4 slide at their tips on the inner peripheral surface of the liner 8 to cause the suction fluid to be sucked into the compression chambers 15 through the inlet ports 9 and inlet openings 9', compressed therein and discharged into the delivery chamber 19 through the outlet ports 10 and outlet openings 10' and the discharge valves 11 which are opened by the pressure of the compressed fluid. On this occasion, at the seals 22, 22', the liner 8 undergoes the reaction of the rotor 1 which acts normally thereto and the pressure of compressed fluid confined between adjacent vanes 4, the rotor 1 and the liner 8 on the discharge side 5*b*, the reaction and the pressure acting in the radially outward direction, while the rotor 1 undergoes the pressure of pumped compression fluid introduced into the recesses 16, 16' through the communication bores 18, 18' and the restituting elastic force of the liner 8, the pumped fluid pressure and the elastic force acting in the radially inward direction. Thus, at the seals 22, 22', the liner 8 and the rotor 1 are kept in close contact with each other, with the above-mentioned pressures and forces well balanced. This arrangement provides high fluid tightness between the rotor 1, the cylinder 6 and the liner 8 even with low machine tolerances.

After a long period of operation of the vane compressor, the liner 1 and the rotor 1 become worn. However, since the liner 8 has breaks 12, 12' and accordingly is expansible due to its own elasticity, the liner 8 is displaced toward the rotor 1 at the seals 22, 22' with abrasion in the peripheral surface of the rotor 1, to always maintain high fluid tightness at the seals 22, 22'.

Although the liner 8 has one break 12 in the embodiment of FIGS. 1 through 3, and two breaks 12, 12' in the embodiment of FIGS. 4 through 6, the number of the break is not limitative but may be three or more.

Obviously many modifications and variations of the present invention are possible in the light of the above disclosure. It is therefore to be understood that within the scope of the apppened claims the invention may be practiced otherwise than as specifically described.

What is claimed is:

1. A vane compressor comprising: a cylindrical peripheral wall member having an endless camming inner peripheral surface; first and second end wall members secured to opposite ends of said cylindrical peripheral wall member and defining a pump housing in cooperation therewith; a cylindrical rotor rotatably fitted within said pump housing in concentricity with said cylindrical peripheral wall member, said cylindrical rotor having an outer peripheral surface thereof formed with a plurality of axial slits; a plurality of vanes each inserted in a different one of said axial slits of said rotor for radial sliding motions therein; a liner member disposed on said cylindrical peripheral wall member along a substantially whole endless camming inner peripheral surface thereof, said liner member being formed in a separate body from said peripheral wall member and formed of a material having a higher resistance against abrasion than said wall member, said liner member having an inner peripheral surface thereof formed with at least one break extending thereacross and through a whole thickness thereof, said liner member being elastically radially outwardly unfoldable due to the presence of said break and having a whole surface thereof elastically permanently urging said cylindrical peripheral wall member in radially outward directions; and means for preventing circumferential dislocation of said liner member; said endless camming inner peripheral surface of said cylindrical peripheral wall member having opposite inner peripheral surface portions defining a minimum inner diameter thereof therebetween, said opposite inner peripheral surface portions being formed with first and second elongate recesses opening in said endless camming inner peripheral surface and extending thereacross and parallel with the axis of said rotor; said cylindrical peripheral wall member including passage means for guiding compression fluid pumped out of said pump housing into said elongate recesses; said liner member extending across said recesses over circumferential lengths thereof and being partially urgedly bent by said rotor and located in said elongate recesses, each of said recesses and said liner member cooperating to define a space therebetween; whereby said compression fluid pumped out of said pump housing is introduced into said space through said passage means to keep said liner member and said rotor in close contact with each other.

2. The vane compressor as claimed in claim 1, wherein said cylindrical peripheral wall member includes two pairs of compression fluid inlet ports and compression fluid outlet ports circumferentially arranged, said elongate recesses being located between said inlet ports and said outlet ports of respective pairs.

3. The vane compressor as claimed in claim 1, wherein said vanes, said first and second end wall members and said liner member are formed of iron or an alloy thereof, and said rotor and said cylindrical peripheral wall member aluminum or an alloy thereof, respectively.

4. The vane compressor as claimed in claim 1, wherein said means for preventing circumferential dislocation of said liner member comprises at least one sheet-like protuberance radially outwardly protruding integrally from said liner member, and at least one second recess formed in said cylindrical peripheral wall member and engaging said protuberance.

5. The vane compressor as claimed in claim 4, including at least one compression fluid inlet port formed in said cylindrical peripheral wall member, and at least one compression fluid inlet opening formed in said liner member and aligned with said compression fluid inlet port of said cylindrical peripheral wall member, said protuberance being formed on an edge of said compression fluid inlet opening of said liner member and engaged in said compression fluid inlet port of said cylindrical peripheral wall member, which forms said second recess.

6. The vane compressor as claimed in claim 1, wherein said break of said liner member extends obliquely with respect to the axis of said rotor.

* * * * *